US009316455B2

(12) United States Patent
Hirschheiter

(10) Patent No.: US 9,316,455 B2
(45) Date of Patent: Apr. 19, 2016

(54) SPRING FOR A TRIGGER SLIDE OF A PISTOL

(71) Applicants: Glock Technology GmbH, Deutsch Wagram (AT); Elisabeth Hirschheiter, Pörtschach (AT)

(72) Inventor: Reinhold Hirschheiter, Pörtschach (AT)

(73) Assignee: GLOCK TECHNOLOGY GMBH (AT)

( * ) Notice: Subject to any disclaimer, the term of this patent is extended or adjusted under 35 U.S.C. 154(b) by 0 days.

(21) Appl. No.: 14/567,908

(22) Filed: Dec. 11, 2014

(65) Prior Publication Data

US 2015/0211822 A1 Jul. 30, 2015

(30) Foreign Application Priority Data

Dec. 11, 2013 (EP) ..... 13196632

(51) Int. Cl.

| | |
|---|---|
| ***F41A 19/06*** | (2006.01) |
| ***F41A 19/10*** | (2006.01) |
| ***F41A 19/12*** | (2006.01) |
| ***F41A 19/32*** | (2006.01) |

(52) U.S. Cl.

CPC ..... *F41A 19/06* (2013.01); *F41A 19/10* (2013.01); *F41A 19/12* (2013.01); *F41A 19/32* (2013.01)

(58) Field of Classification Search

CPC ..... F41A 19/06; F41A 19/10; F41A 19/12; F41A 19/32; F41A 19/31

USPC ..... 42/69.01

See application file for complete search history.

(56) References Cited

U.S. PATENT DOCUMENTS

| | | | | | |
|---|---|---|---|---|---|
| 4,539,889 | A * | 9/1985 | Glock | F41A 5/04 | 89/147 |
| 5,640,794 | A * | 6/1997 | Gardner | F41A 19/35 | 42/69.02 |
| 6,347,473 | B1 * | 2/2002 | Buffoli | F41A 17/82 | 42/66 |
| 6,347,474 | B1 * | 2/2002 | Wolff, Jr. | F41A 19/10 | 42/69.01 |
| 6,354,032 | B1 * | 3/2002 | Viani | F41A 19/10 | 42/42.03 |
| 6,665,973 | B1 * | 12/2003 | Peev | F41A 19/33 | 42/69.01 |
| 7,703,230 | B2 * | 4/2010 | Curry | F41A 17/72 | 42/70.01 |
| 7,810,268 | B1 * | 10/2010 | McGarry | F41A 11/00 | 42/69.01 |
| 7,827,720 | B1 * | 11/2010 | Erdem | F41A 17/42 | 42/70.01 |
| 2005/0034344 | A1 * | 2/2005 | Viani | F41A 19/44 | 42/69.01 |
| 2006/0248772 | A1 * | 11/2006 | Curry | F41A 19/28 | 42/69.02 |
| 2006/0249014 | A1 * | 11/2006 | Curry | F41A 11/00 | 89/196 |
| 2011/0017057 | A1 * | 1/2011 | Loganchuk | F41A 3/38 | 89/140 |
| 2012/0167426 | A1 * | 7/2012 | O'Clair | F41A 11/02 | 42/14 |

(Continued)

*Primary Examiner* — Joshua Freeman

(74) *Attorney, Agent, or Firm* — Kolisch Hartwell, P.C.

(57) ABSTRACT

A pistol with a trigger spring which assists the trigger movement counter to the force of a restoring spring and acts at one end on the trigger slide and at the other end directly or indirectly on the housing of the pistol. In order further to improve the trigger spring, it is provided that said trigger spring is a helical spring which is loaded in compression and the interior of which contains a guide pin which, in the region of one of the ends thereof, has a transverse bolt with which said guide pin rests in a groove fixed on the housing, and which, in the region of the other end thereof, holds a first end region of a hook in a movably mounted manner, the second end region of which hook is of U-shaped design, and in that part of the trigger slide is mounted in said U-shaped end.

2 Claims, 4 Drawing Sheets

(56) References Cited

U.S. PATENT DOCUMENTS

2013/0000171 A1* 1/2013 da Silveira ..... F41A 19/12 42/69.01
2013/0340309 A1* 12/2013 Lee ..... F41A 19/10 42/69.01
2014/0000578 A1* 1/2014 Huang ..... F41B 11/70 124/72
2015/0153126 A1* 6/2015 Bender ..... F41A 19/14 42/69.01
2015/0192378 A1* 7/2015 Hirschheiter ..... F41A 17/36 42/7
2015/0211822 A1* 7/2015 Hirschheiter ..... F41A 19/10 42/69.01

* cited by examiner

-- PRIOR ART --

-- PRIOR ART --

-- PRIOR ART --

SPRING FOR A TRIGGER SLIDE OF A PISTOL

The invention relates to the spring for a trigger slide of a pistol, according to the preamble of claim 1 and the applicant's EP 77 790, and also to corresponding U.S. Pat. No. 4,825,744 A, U.S. Pat. No. 4,893,546 A and U.S. Pat. No. 4,539,889 A. The content of these three documents is incorporated by reference in the content of the present application for the jurisdictions in which this is possible.

Figure 1:
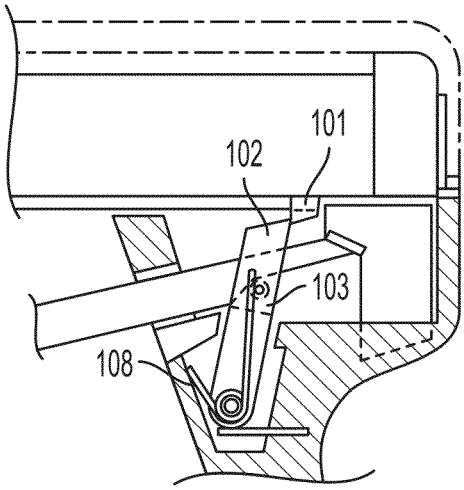
Figure 2:
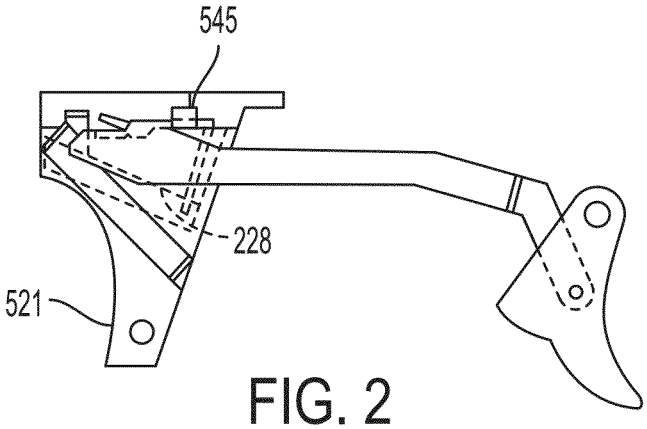
Figure 3:
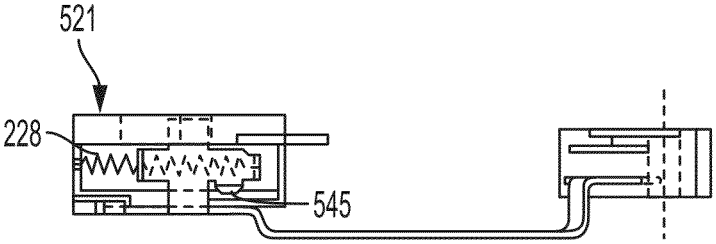

FIGS. 1-3 of the document mentioned first show, as an example of the prior art, two types of springs for trigger slides; these illustrations correspond to FIGS. 15, 36 and 37 of the document mentioned at the beginning. The spring 108 illustrated in FIG. 1 is a hairpin spring, the two limbs of which strike at one end against a wall of the pistol housing and at the other end against a bolt of a lever 103 which, at the upper end 102 thereof, holds a firing-bolt nose 101 counter to the force of a firing-bolt spring (not illustrated). Such embodiments do not occur in practice.

FIG. 2 and FIG. 3 show a helical spring 228, the two ends of which are bent to form eyes; said eyes are fastened at one end to an insert part 521, which is arranged fixedly with respect to the frame of the pistol (not illustrated in this figure), and at the other end to the trigger slide, which holds the firing-bolt nose (not illustrated) by means of a wing 545 and acts as a tension spring.

Helical springs of this type are found in numerous pistols which have been introduced, also by the applicant; the guides of the trigger slide and of that part which bears the wing 545 are designed differently, but this does not make any change with regard to the arrangement and the function of the helical spring.

A different spring, namely for resetting the trigger bar of a hand gun, is known from WO00/65295. The content of this document and of U.S. Pat. No. 6,347,474, which corresponds thereto, is incorporated by reference in the content of the present application for the jurisdictions in which this is possible. It is provided here that a pretensioned compression spring is arranged eccentrically with respect to the axis of rotation of the trigger bar and is tensioned further by the triggering movement of the trigger bar, as a result of which, when the trigger bar is released, the latter is returned into the starting position.

From US 2011/0017057, it is known, in the case of a hand gun with an extremely complex trigger system and, in relation to the axis of the barrel, a purely axial movement of the sliding carriage in the housing of the gun and of a firing bolt within the sliding carriage with a likewise purely axial movement with respect to the sliding carriage, to ensure the different movements and rest positions of the individual parts with respect to one another by means of compression springs between corresponding supports or disk springs.

The springs explained at the beginning with reference to FIGS. 1-3 have been tried and tested over many years and in large piece numbers, but there is the constant issue of further extending the service life of the individual parts and of eliminating weak points even present only hypothetically. It is the object of the invention to specify a solution here, in which the service life is further improved, without increasing the costs.

According to the invention, these objects are achieved by the measures and features specified in the characterizing part of claim 1; in other words, the helical spring for the trigger slide is formed by a compression spring which is arranged around a pin, the pin is provided, in the region of one end thereof, with a transverse bolt with which said pin is mounted in an articulated manner in the insert part fixed on the frame, and, at the other end thereof, has an abutment for a hook part which is movable and is pressed only frictionally against the abutment by the spring. The hook part, at the other end thereof, which is of hook-shaped design, pushes the slide, which bears the stop for the firing-bolt nose, rearwards and upwards (as seen in relation to the pistol).

Figure 4:
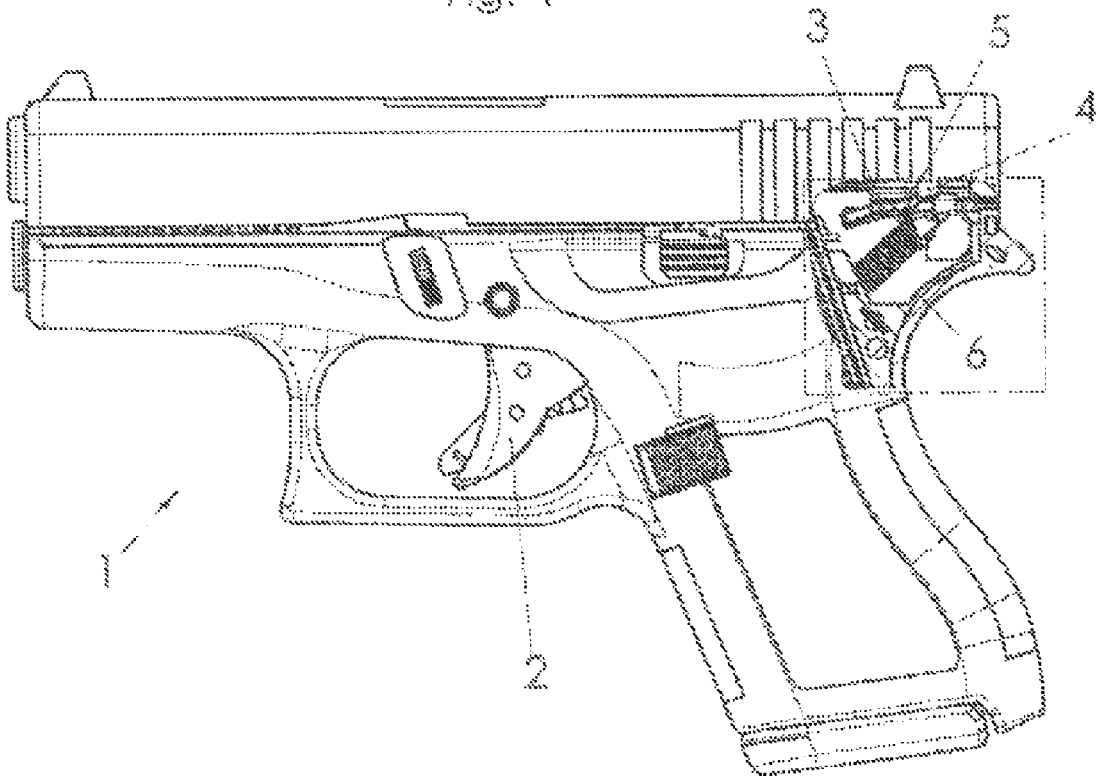
Figure 5:
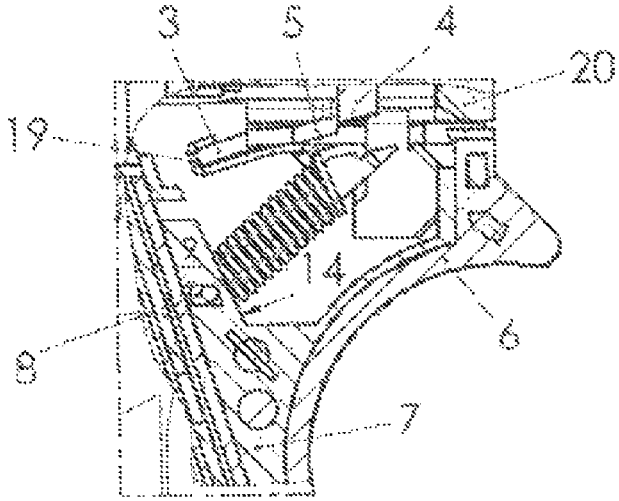
Figure 6:
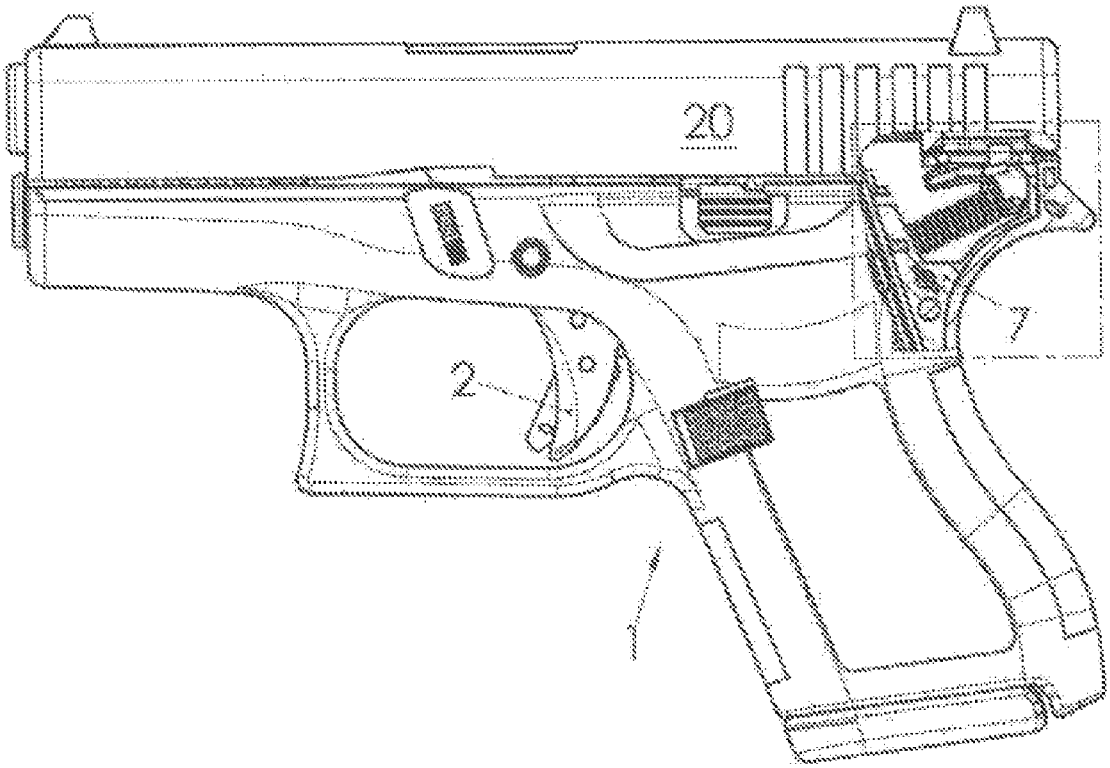
Figure 7:
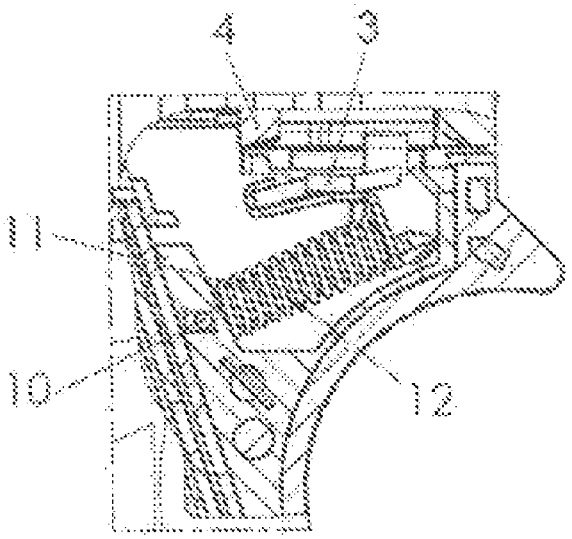
Figure 8:
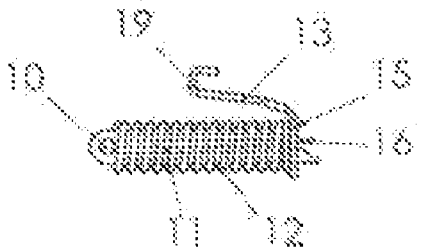
Figure 9:
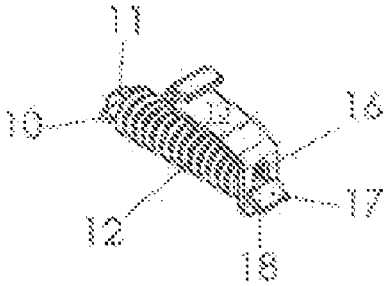

The invention is explained in more detail below with reference to the drawing, in which FIGS. 1 to 3 show the prior art, FIG. 4 shows a pistol in side view, partially in section, in a state ready for firing, FIG. 5 shows the detail V from FIG. 4, FIG. 6 shows an illustration as per FIG. 4, after the firing of a shot, FIG. 7 shows the detail VII from FIG. 6, FIG. 8 shows the spring according to the invention together with hook part in side view, and FIG. 9 shows the spring from FIG. 8 in a perspective view.

FIGS. 1-3 illustrate the prior art explained further above and are therefore not explained further here.

FIG. 4 shows a pistol 1 with a trigger 2 and a trigger slide 3 which is partially visible in the broken-open part of the illustration. The trigger slide 3 projects with a holding part 5 into the path of movement of a firing-bolt nose 4, which is visible as a single part of the firing bolt in FIG. 5.

An insert part 7 is inserted in the frame 6 of the pistol 1 and is fixed in the manner known in the prior art. Said insert part 7 has, on the front side thereof with respect to the pistol, a limb 9 which has a slot in the region of the center planes of the pistol. Furthermore, said limb 9, which is therefore formed in duplicate, has a groove 8 running transversely with respect to the plane of symmetry of the pistol. A transverse bolt 10 (FIGS. 8 and 9) of a guide pin 11 of the trigger spring 12 lies in said groove 8. The region of the guide pin 11 at the end which bears the transverse bolt 10 comes to lie between the two limbs 9, as is readily apparent from FIG. 5.

The trigger spring 12 is supported, at the end thereof which is close to the transverse bolt, on the inner surface 14 of the insert part 7. As in particular FIG. 8 makes apparent, the other end of the trigger spring 12 is supported on a supporting surface 15 of a hook 13 and pushes the latter, by the end surface 16 thereof opposite the supporting surface 15, against a spring holder 17, which is formed integrally with the guide pin 11. In the region of the supporting surface and end surface 15, 16, the hook 13 has a mounting opening 18 which differs from the circular shape and the size and cross-sectional shape of which are coordinated with the size and cross-sectional shape of the spring holder 17 in such a manner that, in the rotated state with respect to the axis of the guide pin 11, the hook 13 can be pushed over the spring holder 17 and, after rotation into the position illustrated in FIG. 9, is held by said spring holder.

The other end of the hook 13, the end remote from the spring, is designed in the form of a "U", as seen in cross section (FIG. 8), and therefore as a U end 19 and, as can readily be seen in FIG. 5, grips around the front edge of a projection of the trigger slide 3.

The tensioning spring with mounting eyes is thereby replaced by an even more robust compression spring in which, in particular, the transition from the helical shape to the eye shape, which transition always requires care, is avoided.

FIGS. 6 and 7 each show the same illustration as in FIGS. 5 and 6, with the difference that the situation here is illustrated directly after a shot has been released.

The trigger spring according to the invention is mounted in an extremely simple manner in one of two ways: in the first embodiment, the trigger spring 12 is pushed via the guide pin 11 as far as the stop against the end surface 16 of the hook 13, and then the transverse bolt 10 is inserted and fixed, either by means of adhesive or by means of friction, optionally in combination with a matching change in diameter. In the second embodiment, the transverse bolt is already mounted fixedly and the trigger spring 12 is pushed on with hook 13 removed. The hook 13 is subsequently rotated through 90° with respect to the illustrations in FIGS. 8 and 9, and pushed with the mounting opening 18 thereof over the spring holder 17, wherein, when the trigger spring 12 is mounted previously, the final axial movement and the rotation into the position illustrated in the drawing take place under the action of the trigger spring 12.

The assembled spring is mounted in the insert part 7 before the latter is introduced into the housing, and captive premounting takes place by means of the pretensioning of the trigger spring 12 against the inner side of the insert part (FIG. 7). The projection of the trigger slide 3 is subsequently pushed into the U end 19 of the hook 13, but likewise before the insertion into the housing; the interaction with the firing-bolt spring is automatically produced when the sliding carriage is placed on and pulled back for the first time.

In summary, it can be stated that the invention relates to a pistol 1 which is equipped with a trigger spring 12 which assists the trigger movement counter to the force of a restoring spring 21 and acts at one end on the trigger slide 3 and at the other end directly or indirectly on the housing 6 of the pistol 1. The essence of the invention here is that the trigger spring 12 is a helical spring, the interior of which contains a guide pin 11 which, in the region of one of the ends thereof, has a transverse bolt 10 with which said guide pin rests in a groove 8 fixed on the housing, and which, in the region of the other end thereof, holds a first end region of a hook 13 in a movably mounted manner, the second end region of which hook is of U-shaped design, and that part of the trigger slide 3 is mounted in said U-shaped end.

LIST OF REFERENCE NUMBERS

| | |
|---|---|
| 1 | Pistol |
| 2 | Trigger |
| 3 | Trigger slide |
| 4 | Firing-bolt nose |
| 5 | Holding part |
| 6 | Frame |
| 7 | Insert part |
| 8 | Groove |
| 9 | Limb |
| 10 | Transverse bolt |
| 11 | Guide pin |
| 12 | Trigger spring |
| 13 | Hook |
| 14 | Inner surface |
| 15 | Supporting surface |
| 16 | End surface |
| 17 | Spring holder |
| 18 | Mounting opening |
| 19 | U end |
| 20 | Sliding carriage |
| 21 | Restoring spring |

What is claimed:

1. A pistol, comprising:

a pistol housing;

a trigger slide disposed in the pistol housing and coupled to a trigger;

a trigger spring having a first end and a second end; wherein the trigger spring is a helical spring that is loaded in compression;

a guide pin disposed in an interior of the trigger spring; wherein in a region of the first end of the trigger spring the guide pin includes a transverse bolt that rests in a groove fixed on the pistol housing;

in a region of the second end of the trigger spring the guide pin holds a first end of a hook in a movably mounted manner, where the region of the second end of the hook includes a U-shaped design having a part of the trigger slide mounted therein;

wherein the first end of the trigger spring acts directly or indirectly on the pistol housing via the transverse bolt and the second end of the trigger spring acts upon one end of the trigger slide via the U-shaped design of the hook, such that the trigger spring is configured to assist a trigger movement counter to a force applied by a restoring spring.

2. The pistol of claim 1, wherein an end of the guide pin that is remote from the transverse bolt includes a flattened portion and a widened portion disposed parallel to the transverse bolt, so that the flattened portion is configured to serve as a spring holder; and wherein the hook includes a mounting opening that, in at least one angular position, permits a passage of the flattened portion and, in at least one other angular position, prevents the passage of the flattened portion.

* * * * *